United States Patent [19]

Kramer

[11] Patent Number: 4,503,903

[45] Date of Patent: Mar. 12, 1985

[54] HEAT EXCHANGER TUBE SHEET RADIAL SUPPORT

[75] Inventor: Arthur W. Kramer, St. Petersburg, Fla.

[73] Assignee: Westinghouse Electric Corp., Pittsburgh, Pa.

[21] Appl. No.: 395,549

[22] Filed: Jul. 6, 1982

[51] Int. Cl.[3] ..... F28F 7/00

[52] U.S. Cl. ..... 165/76; 165/161; 165/162; 122/510; 122/512

[58] Field of Search ..... 165/76, 162, 161; 122/510, 512

[56] References Cited

U.S. PATENT DOCUMENTS

| | | | |
|---|---|---|---|
| 2,267,839 | 12/1941 | Rehm | 122/510 |
| 2,343,502 | 3/1944 | Fields | 165/76 X |
| 2,391,876 | 1/1946 | Brown | 165/76 |
| 3,201,108 | 8/1965 | Kramer | 165/81 X |
| 3,393,665 | 7/1968 | Jochtern | 122/510 |
| 4,143,708 | 3/1979 | Haynes | 165/76 |
| 4,371,035 | 2/1983 | Soligno | 165/162 |

*Primary Examiner*—William R. Cline
*Assistant Examiner*—John F. McNally
*Attorney, Agent, or Firm*—G. H. Telfer

[57] ABSTRACT

Radial support of a tube support plate is provided by two associated members which also permit the position of the tube support plate to be adjusted with significantly improved ease. The apparatus comprises a jacking member which extends radially through the heat exchanger's inner shell and is in positive contact with its outer shell. A locking screw extends radially inward from the jacking screw and is in contact with the tube support plate. After this apparatus is used to centrally locate the tube support plate, it is welded together and to the inner shell.

5 Claims, 5 Drawing Figures

PRIOR ART
FIG. 2.
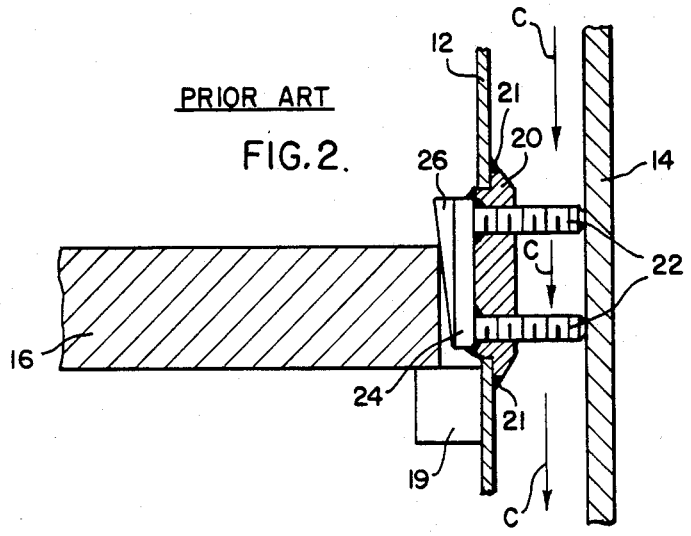
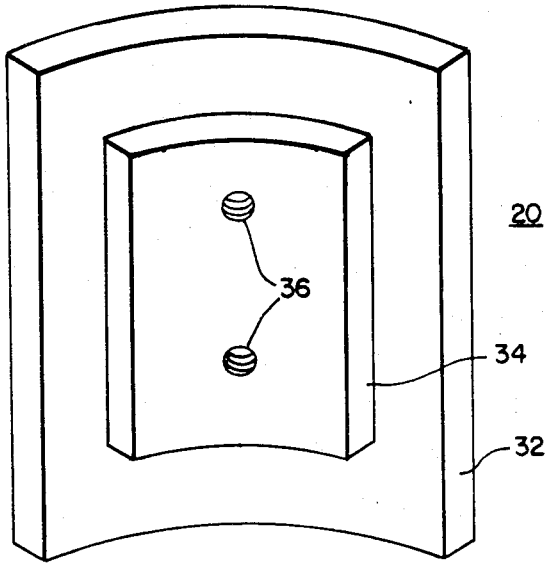
PRIOR ART
FIG. 3.

HEAT EXCHANGER TUBE SHEET RADIAL SUPPORT

BACKGROUND AND SUMMARY OF THE INVENTION

The present invention relates generally to heat exchangers which utilize a plurality of tubes disposed therein and, more particularly, to tube sheet support mechanisms which provide radial support to a tube sheet and transfer forces radially from the tube sheet to an outer shell structure of the heat exchanger. More specifically, the present invention relates to a radial support mechanism which transfers radial forces to the outer shell of a steam generator which comprises two coaxially associated shells.

In nuclear power generating systems, heat exchangers are used generally to transfer heat from a radioactive fluid to a non-radioactive fluid which will eventually flow through a turbine. These two fluids are isolated from each other to prevent radioactive contamination of the turbine. This heat exchanger, when utilizing water as the heat transferring medium, is referred to as a steam generator and will be referred to as such herein. Typically, a steam generator of this kind is constructed with an outer shell structure which contains both the radioactive and non-radioactive fluids, each flowing through individual separate passageways. Within this outer shell, the steam generator is compartmentalized to provide a means for providing thermal communication between these fluids without permitting them to come into physical contact with one another. This can be accomplished by passing one of the fluids through a plurality of thermally conductive tubes while causing the other fluid to flow around and in contact with the outside surfaces of these tubes.

The above-mentioned heat exchanger tubes may be U-shaped in such a way as to connect, in fluid communication, two adjacent fluid compartments located at the same end of the heat exchanger, or, alternatively, the tubes may be straight and connect, in fluid communication, compartments located at opposite ends of the heat exchanger. In either case, the fluid flowing around the outside surfaces of the heat exchanger tubes can cause lateral movement and possibly severe vibration in those tubes. In order to provide lateral support for the heat exchanger tubes, which may be of significant length, tube support plates are disposed within the steam generator. These tube support plates generally are flat circular plates with a plurality of holes through their planar surfaces. The tubes of the heat exchanger are passed through these holes with a minimal clearance so that the lateral movement of the tubes is constrained by the tube support plate. It should be understood that the tube support plate is typically designed to provide no restriction on a tube's longitudinal movement through the plate but, only to provide support which prevents lateral movement radial to the tubes which would otherwise be caused by the rapid passage of fluid over their outside cylindrical surfaces.

In steam generators which utilize a two shell construction with the tube support plates being disposed inside the inner shell, it sometimes becomes necessary to radially support the tube support plates in a way that transfers radial forces to the outer shell because of its greater strength. Even in circumstances which do not require this transfer of radial forces to the outer shell, the inner shell must usually be strengthened in some manner in order to be able to withstand radial forces exerted by the tube support plate. In this latter case, the inner shell must be locally strengthened in the region where forces from the tube support plate can be encountered.

The present invention is particularly applicable to steam generators with this type of two-shell construction. It comprises a means for exerting a force between the inner of the two shells and the tube support plate in a direction radial to the inner shell. Also, it comprises means for exerting a force between the inner and outer shells. The combination of these two means, rigidly connected to each other, transfers radial forces from the tube support plate to the outer shell and avoids potential damage to the inner shell caused by these forces. These two portions of the present invention are in threaded association with each other in a way that enables them to adjust for varying radial distances between the outer cylindrical surface of the tube support plate and the inner cylindrical surface of the outer shell. This threaded association also enables the tube support plate to be centered in relation to the inner shell during initial construction. Once assembled, the segments of the present invention can be welded to each other and also to the inner shell in such a way as to result in its rigid attachment to the inner shell.

The present invention provides a means for radially supporting a tube support plate in a steam generator while transferring radial forces from the tube support plate directly to the outer shell while avoiding potential damage to the lower strength inner shell during periods when severe radial forces on the tube support plate are experienced.

BRIEF DESCRIPTION OF THE DRAWINGS

FIG. 2 depicts a former method of providing radial support to a tube support plate;

FIG. 3 shows a portion of the tube support plate mechanism of FIG. 2;

DESCRIPTION OF THE PREFERRED EMBODIMENT

The present invention relates generally to a means for radially supporting a tube support plate of a steam generator and, more particularly, to an apparatus which provides radial support for a tube support plate and transfers radial forces exerted by the tube support plate directly to an outer shell of a steam generator.

Figure 1:
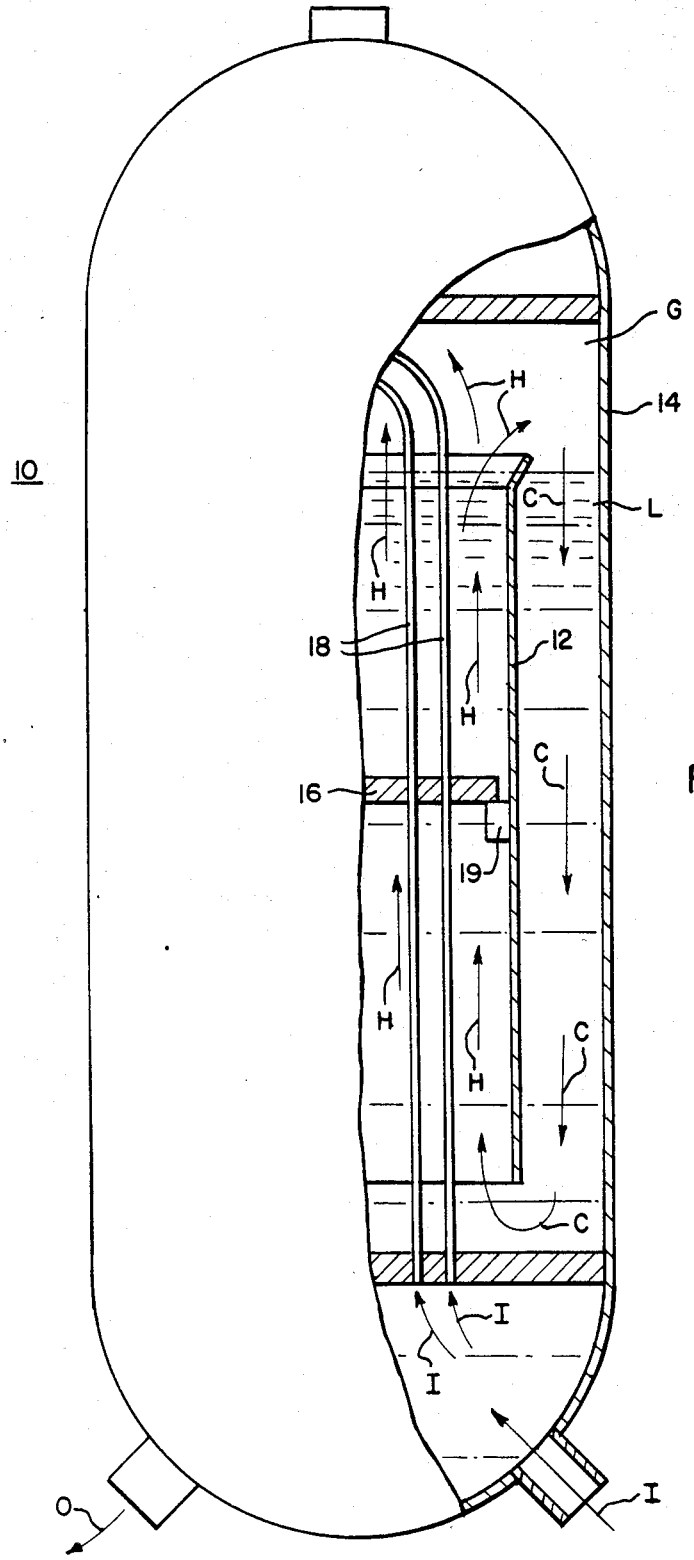
FIG. 1 illustrates an exemplary steam generator.

FIG. 1 illustrates an exemplary steam generator 10 which is internally divided into separate compartments. It comprises inner 12 and outer 14 shells. The outer shell 14 provides a containment for the portions of its heat exchanging equipment. The inner shell 12 serves to provide axial support for the tube support plates 16 and also provides a barrier which aids in fluid flow throughout the steam generator 10. A plurality of tubes 18 provide a conduit through which a fluid passes from an input area (designated by arrows I) to an output area (designated by arrows O). A separate fluid is circulated throughout the steam generator and around the outer cylindrical surfaces of the tubes 18. This fluid is in thermal communication with the fluid flowing inside the plurality of tubes 18 and is heated by its contact with the outer surfaces of the tubes 18. The heated fluid travels adjacent to the plurality of tubes 18 and is heated as it travels the path indicated by arrows H. This fluid exits from the steam generator in the form of steam and proceeds to a turbine of an electrical generating system, returning to the steam generator with a reduced temperature. This cooler fluid passes between the inner 12 and outer 14 shells of the steam generator (as indicated by arrows C) and is once again conveyed to a region proximate the plurality of tubes 18 to be heated again. This fluid thus exists in both the liquid L and gaseous G states within the steam generator.

In FIG. 1 and in the illustration described above, the fluid passing through the plurality of tubes 18 and indicated by arrows I and O, is radioactive after having come directly from a nuclear reactor to the steam generator. Also, it should be understood that the other fluid within the steam generator flowing around the outside surface of the tubes 18, and indicated by arrows C and H, is non-radioactive and one of the functions of the steam generator 10 is to transfer heat from the radioactive fluid to the non-radioactive fluid while keeping them segregated. It should further be understood that other designs of steam generators could pass non-radioactive water through the tubes 18 and radioactive water around the tubes 18 as an alternative to the procedure described herein. However, it should be equally understood that the present invention is applicable to either type of steam generator and is also applicable to heat exchangers which utilize straight tubes instead of the U-shaped tubes shown in FIG. 1.

The tube support plate 16 of a steam generator is typically supported in the axial direction by a plurality of blocks 19 welded to the inner shell 12. Radial support of the tube support plate must also be provided by some means (not shown in FIG. 1).

FIG. 2 illustrates one way to provide the radial support required for a tube support plate 16. This procedure, known to those skilled in the art, utilizes a specially shaped block 20 which is inserted into a hole burned radially through the inner shell 12. The block 20 is then welded 21 to the inner shell 12 to provide a rigid attachment therebetween. The block 20 is drilled and tapped with one or more radially extending holes into which threaded members 22 are disposed. The block 20 is radially aligned with the tube support plate 16 in such a way that the threaded members 22 can be extended from the block 20 toward the tube support plate 16. A jacking block 24 is then placed between the threaded members 22 and the tube support plate 16 in close proximity to the tube support plate 16. Wedges 26 are then driven between the jacking block 24 and the tube support plate 16 in order to provide positive contact therebetween. The wedges 26 are then welded to the jacking block 24 which, in turn, is welded to the threaded members 22 which have already been rigidly fixed, by welding, to the block 20. This configuration provides a rigid assembly comprising the block 20, threaded members 22, jacking block 24, and the wedges 26, all rigidly connected to the inner shell 12.

Prior to welding the components of this radial support mechanism together, their relative dimensions must be assured to result in the centering of the tube support plate 16 within the inner shell 12. It should be apparent that the use of the wedges 26 to accurately center the tube support plate 16 within the steam generator is difficult due to the fact that wedges typically are not suitable for making fine dimensional adjustments. Other disadvantages of this former method are that the thickness of the block 20, in order to provide localized strength to the inner shell 12, must extend radially outward from the inner shell 12 a significant amount. As shown in FIG. 2, this extension can interfere with the laminar flow of the cooled liquid as indicated by arrows C. Furthermore, in nuclear power generating systems it is desirable to minimize the number of individual components within the steam generator. From the above discussion it should be obvious that each radial support apparatus, as illustrated in FIG. 2, comprises many individual components, each of which may loosen during operation and provide a potential deleterious situation.

It should further be apparent that the overall cost of the above-described method is high. This cost arises from the need for burning a relatively large hole radially through the inner shell 12, forming the block 20 and positioning the tube support plate 16 accurately within the inner shell 12 by the repeated adjustment of the threaded members 22 and wedges 26. It has been found that the manufacture of the block 20, as depicted in FIG. 3, is both difficult and expensive. The block 20 is formed to provide an outer portion 32 which is arcuately shaped to fit the outer circumferential surface of the inner shell (reference numeral 12 in FIG. 2) while an inner portion 34 is shaped to fit within a hole formed radially through the inner shell 12. Both the inner 34 and outer 32 portions of this block must be accurately shaped into an arcuate configuration in order to be properly associated with the hole and the outer surface of the inner shell 12. Furthermore, the two holes 36 must be formed into the block 20 and threaded to receive their associated threaded members (reference numeral 22 in FIG. 2).

Figure 4:
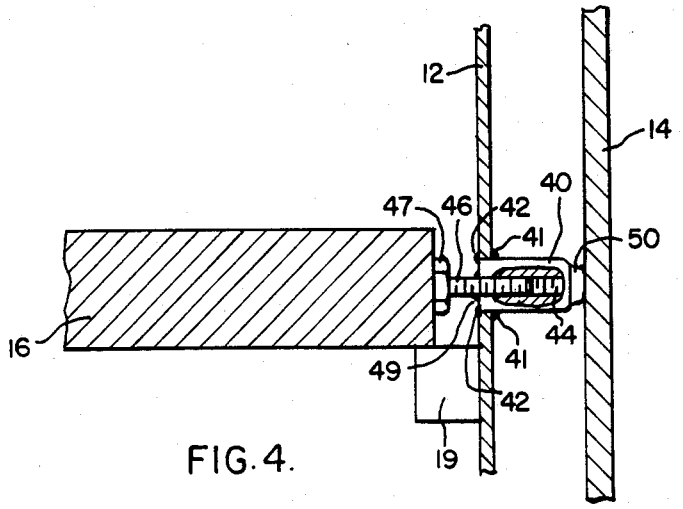
FIG. 4 illustrates the radial tube support apparatus of the present invention.

The present invention is exemplarily illustrated in FIG. 4, showing the inner 12 and outer 14 shells along with the tube support plate 16 and a block 19 which provides axial support for the tube support plate 16. The present invention comprises a jacking member 40, or jacking screw, which extends through a hole in the inner shell 12 and is in contact with the inner cylindrical surface of the outer shell 14. When thus disposed, the jacking member 40 is rigidly connected to the inner shell 12 by welding it, for example, as shown by reference numerals 41 and 42. Once rigidly fastened to the inner shell 12 while in positive contact with the outer shell 14, all radial forces experienced by the inner shell 12 in the region of the jacking member 40 will be transferred radially to the stronger outer shell 14. The jacking member 40 is provided with a central bore 44 which is shaped to receive a locking screw, or threaded member, 46. The threaded member 46 is provided with a head 47 which, for ease of adjustment, has a plurality of flat sides. It should be understood that by extending the threaded member 46 from the jacking member 40, the radial position of the head 47 can be accurately adjusted in order to radially position the tube support plate 16. Although the preferred embodiment of the present invention utilizes a threaded member 46 disposed in threaded association with the jacking member 40, it should be understood that an alternative configuration could have a rod slidably disposed within the hole 44 in the jacking member 40.

As illustrated in FIG. 4, it should be apparent to one skilled in the art that the head 47 of the threaded member 46 can easily be extended radially either inward or outward by rotating the head 47. This can be accomplished by the use of an open-ended wrench and does not require specialized tooling. It should further be apparent that, depending on the pitch of the threads of the threaded member 46, the head 47 can be positioned radially within the steam generator to an accurate degree. When the tube support plate 16 exerts a radially outward force, it should further be apparent that this force is transferred directly to the outer shell 14 without serious deflection to the inner shell 12. This direct transfer of force eliminates the need for the inner shell to be significantly strengthed in the region of the tube support plate 16. This apparatus also minimizes the total number of individual components required to be included within the steam generator.

By comparing the former method as shown in FIG. 2 to the present invention as illustrated in FIG. 4, the advantages of the present invention should be clearly apparent. The total number of components of the present invention comprise only the jacking member 40 and the threaded locking screw 46 whereas the former method utilized a block 20, threaded members 22, a jacking block 24 and a wedge 26. Also, the cost of manufacturing the apparatus of the present invention is significantly lower than that of the former. As explained above, the complex shape of the block 20 as illustrated in FIG. 3 is difficult, and therefore expensive, to manufacture whereas the jacking block 40 and locking screw 46, depicted in FIG. 5, are relatively easy to manufacture on conventional machinery.

Figure 5:
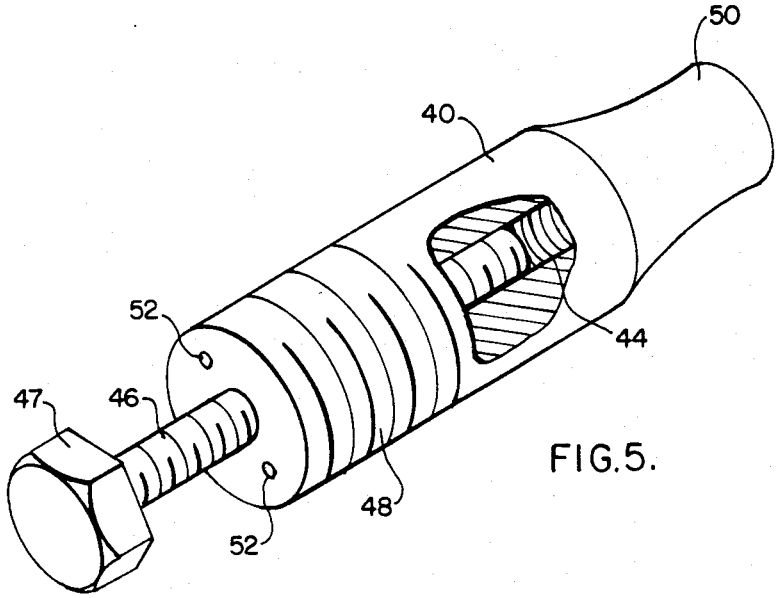
FIG. 5 illustrates a detailed view of the force transferring apparatus of the present invention.

FIG. 5 shows the jacking member 40 and locking screw 46 in greater detail. The jacking member 40 comprises a first end 50 which is shaped to fit against the inner cylindrical surface of the outer shell (reference numeral 14 in FIGS. 1 and 4) while its other end is provided with a means for turning it within the hole of the inner shell 12. In FIG. 5 this means is shown as a pair of holes 52 into which a spanner wrench may be fitted to provide sufficient torque to rotate the jacking member 40 within a threaded hole which extends radially through the inner shell (reference numeral 12 in FIG. 4). The outer cylindrical surface of the jacking member 40 can be thus provided with a threaded portion 48 in order that it can be threadably associated in the above-mentioned hole in the inner shell. The jacking member 40 is also provided with a central hole 44, which can also be threaded in order for it to receive, in threaded association, the locking screw 46, or threaded member. As discussed above, the locking screw 46 is provided with a head 47 which has a plurality of flat sides that enable it to be turned by the use of a conventional open-ended wrench.

After the locking screw 46 is adjusted within the jacking member 40 in order to properly position the tube support plate (reference numeral 16 in FIG. 4), the locking screw 46 can be welded to the jacking member 40 in order to rigidly attach these members together and to guarantee that no relative movement between these members occurs after installation. This welded connection is illustrated by reference numeral 49 in FIG. 4.

It should be apparent to one skilled in the art that the present invention is an apparatus which is relatively easy and inexpensive to manufacture but, that provides a radial support for a tube support plate in a way that can accurately adjust the position of the tube support plate within the steam generator. Furthermore, the present invention provides a means for effectively transferring radial forces exerted by the tube support plate to the outer shell of the steam generator without requiring the inner shell of the steam generator to be significantly strengthened in the region of the tube support plate. Also, it should be apparent that the present invention minimizes the number of components needed to be included within the steam generator in order to provide this radial support and also minimizes the deleterious effect on the fluid flow around the radial support apparatus of the present invention.

What I claim is:

1. A heat exchanger, comprising:

a generally cylindrical shell member;

a generally cylindrical wrapper, said wrapper being disposed within said shell member in coaxial and concentric relation;

a jacking screw disposed through a radial hole in said wrapper, a first end of said jacking screw being in contact with the inner cylindrical surface of said shell member, said jacking screw being rigidly fastened to said wrapper;

a locking screw having a first end which is threaded into a hole in a second end of said jacking screw; and a tube support plate of said heat exchanger having a generally cyindrical outer surface, said tube support plate being disposed within said wrapper in concentric relation, said generally cylindrical outer surface being in contact with a second end of said locking screw.

2. The heat exchanger of claim 1, wherein:

said second end of said locking screw has a head with a plurality of flat sides.

3. The heat exchanger of claim 1, further comprising means for allowing said jacking screw to be rotated about its central axis.

4. A method for radially supporting a tube support plate within a heat exchanger, comprising:

providing a generally cylindrical outer shell of said heat exchanger;

disposing a generally cylindrical inner shell within said outer shell in generally concentric and coaxial relation;

extending a jacking member through a radial hole in said inner shell;

rigidly attaching said jacking member to said inner shell with the radially outward portion of said jacking member in physical contact with said outer shell;

disposing a locking member in threaded relation with the radially inward portion of said jacking member, said locking member extending radially inward from said inner shell;

disposing said tube support plate radially inward from said locking member; and extending said locking member radially inward from said jacking member to exert a radially inward force against said tube support sheet.

5. The method of claim 4, further comprising:

welding said locking member to said jacking member.

* * * * *